US005787594A

United States Patent [19]

Estrada

[11] Patent Number: 5,787,594

[45] Date of Patent: Aug. 4, 1998

[54] DETAILED SHAVING DEVICE

[76] Inventor: Juan Jose Hugo Ceja Estrada, Aquiles Serdan 123 Sur., 80000, Culiacan, Sinaloa, Mexico

[21] Appl. No.: 838,030

[22] Filed: Apr. 22, 1997

Related U.S. Application Data

[63] Continuation-in-part of Ser. No. 386,549, Feb. 10, 1995, abandoned.

[51] Int. Cl.[6] ..... B26B 21/52

[52] U.S. Cl. ..... 30/531; 30/527

[58] Field of Search ..... 30/531, 527, 526, 30/533

[56] References Cited

U.S. PATENT DOCUMENTS

| | | | |
|---|---|---|---|
| 1,247,581 | 11/1917 | Seitz | 30/531 |
| 1,498,890 | 6/1924 | Steedman . | |
| 1,507,737 | 9/1924 | James . | |
| 1,639,441 | 8/1927 | Spahr . | |
| 1,794,656 | 3/1931 | Thompson . | |
| 1,945,117 | 1/1934 | Mann | 30/531 |
| 2,127,010 | 8/1938 | Sampson . | |
| 2,780,866 | 2/1957 | Borden . | |
| 3,045,342 | 7/1962 | Diehl . | |
| 3,964,160 | 6/1976 | Gordon | 30/531 |
| 4,083,103 | 4/1978 | Estandian | 30/531 |
| 4,285,124 | 8/1981 | Diakonov | 30/34.1 |
| 4,461,078 | 7/1984 | Carreker | 30/47 |
| 5,093,991 | 3/1992 | Hendrickson | 30/531 |
| 5,167,069 | 12/1992 | Quinn | 30/533 |
| 5,526,568 | 6/1996 | Coplelan | 30/531 |

*Primary Examiner*—Hwei-Siu Payer

*Attorney, Agent, or Firm*—Karen Lee Orzechowski; Nath & Associates

[57] ABSTRACT

The detailed shaving device includes a spring-mounted, infinitely-positionable, rotating razor blade with a full 360-degree range of motion which is attached to a handle having an angular offset for improved grip. The shaving device allows the user to lock and release the razor blade from its angular position relative to the handle and includes a knob for adjusting the rotation of the blade. The characteristics of spring mounting, infinite position adjustment, and razor blade rotation allow the user to accurately shave difficult to reach areas of the body.

7 Claims, 5 Drawing Sheets

FIG. 4A
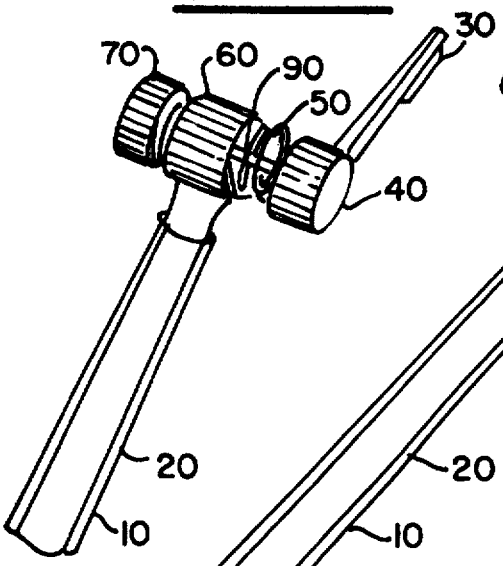
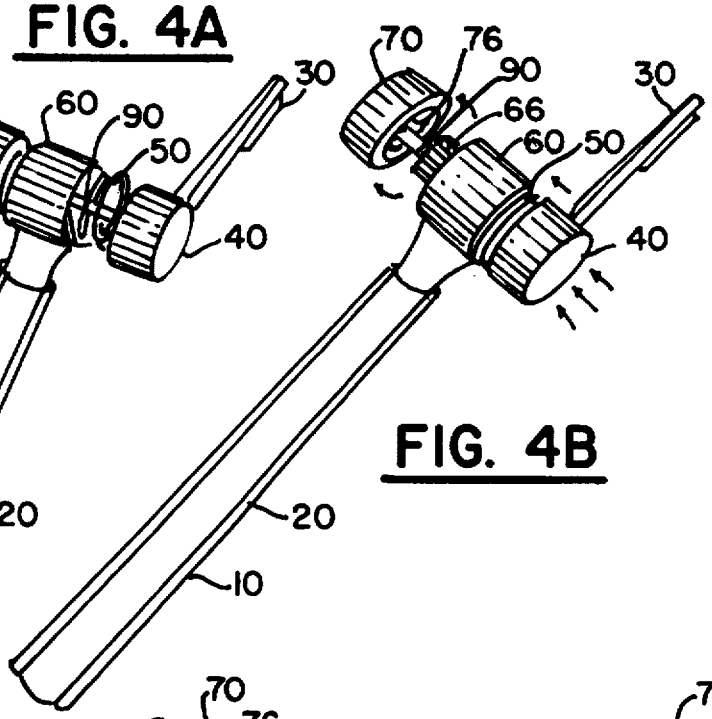
FIG. 4B
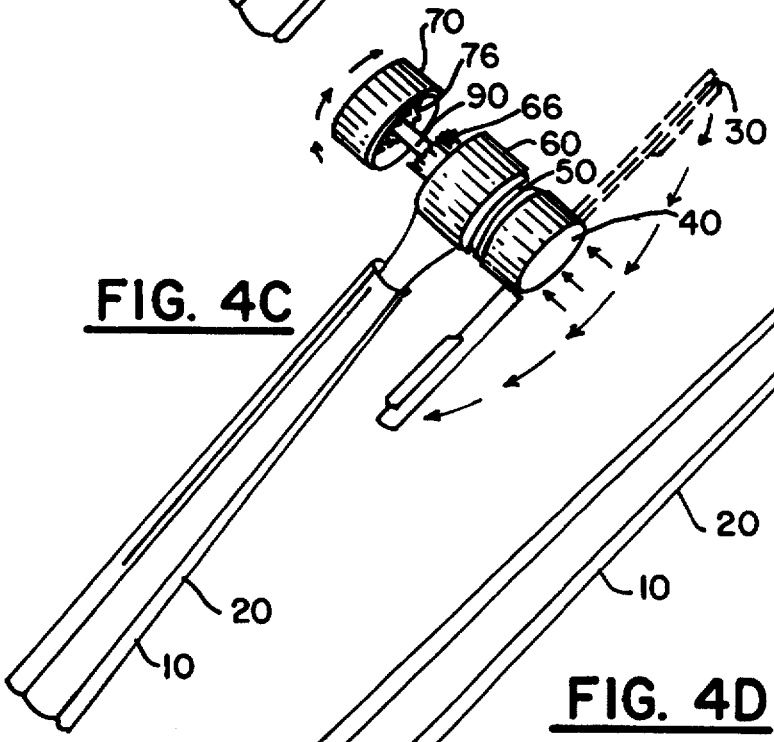
FIG. 4C
FIG. 4D

DETAILED SHAVING DEVICE

This application is a Continuation-In-Part of U.S. Pat. application Ser. No. 08/386,549, filed on Feb. 10, 1995, now abandoned.

FIELD OF THE INVENTION

The present invention relates to a shaving device for precise and detailed cutting, and more particularly, to a shaving device with a head that is fully rotatable in a 360-degree range to accommodate difficult to shave areas of the human face and body.

BACKGROUND OF THE INVENTION

Shaving devices on the marketplace are commonly used to shave various parts of the human body. Typically, the shaving implements are designed for the easy to reach areas of the body and do not take into consideration difficult to reach areas of the body. Whether the shaving devices have a double blade or a mobile head, the precision of detailed shaving is not attained in the prior art. Accordingly, a fully-rotatable shaving device for cutting in difficult to reach areas of the body has hereby been achieved in the field of detailed shaving.

Several shaving devices with a variety of assemblies for difficult shaving tasks have been patented. For example, U.S. Pat. No. 5,526,568 to Copelan discloses a razor with a switch that allows for perpendicular and limited oblique shaving. The invention allows the user to shave in a conventional perpendicular mode or one specific oblique position. Although the invention allows some flexibility related to difficult to shave areas of the body, the limited use of two fixed positions does not permit the comprehensive ergonomic benefits of a full 360-degree rotating blade head.

U.S. Pat. No. 5,167,069 to Quinn discloses a razor shaving apparatus having a telescopically extendable and retractable body. Extending the support arm and blade carriage from the apparatus handle enables a user of the apparatus to extend the shaving blade to areas that the user is incapable of reaching with their hands alone. The invention extends the reach of the individual beyond the reach of their hands but does not solve the problem of ergonomically awkward hand positioning in difficult to reach areas of the body.

U.S. Pat. 4,461,078 to Carreker discloses a razor assembly having two razor heads mounted on the end of a handle, wherein one of the razors is one third the width of the other razors and is used to trim difficult to reach areas. The razors are pivotally mounted so that they may be rotated to a straight line position or to small acute angles. As a result, the user must be careful while trying to shave difficult to reach areas because of the presence of the second razor head. Furthermore, the razor assembly disclosed does not comprise a locking mechanism for maintaining the razor head at a specific angle.

U.S. Pat. No. 4,285,124 to Diakonov discloses a razor assembly for trimming beards and mustaches. The shaving device has a razor blade, a head for holding the razor blade and a blade support, all of which have tapered ends. The tapered configuration permits the user to trim a beard, mustache and the nostril areas. Additionally, the shaving device comprises a miniature safety razor which is movable from a first position to a second position thereby allowing the user to shave the area beneath the user's nose. As a result, the razor assembly disclosed allows the user to carefully shave the beard, mustache and nostril areas, but does not disclose a razor which is rotatable about the handle portion of the razor assembly.

U.S. Pat. No. 3,964,160 to Gordon discloses a safety razor with an angularly adjustable head. The blade-retaining head can be positioned in a limited number of pivotal positions using an indexing mechanism having angularly-spaced notches. Although the invention alleviates many of the ergonomic problems associated with traditional razors, it does not allow an infinite number of positions or a full 360-degree range of rotation.

U.S. Pat. No. 1,247,581 to Seitz discloses a safety razor with an adjustable blade carrying head that allows several angles with relation to the handle. The invention permits the blade to glide freely over the face and remove the hairs from the face without pulling. The finite number of angular positions available with the invention, however, does not eliminate the ergonomic problems associated with limited angular rotation. The invention also does not address the problem of shaving difficult areas of the human body.

Other examples of patented shaving devices include: U.S. Pat. No. 3,045,342 to Diehl disclosing a razor with a shiftable handle means; U.S. Pat. No. 2,127,010 to Sampson disclosing a razor for shaving the eyebrow area; U.S. Pat. No. 1,794,656 to Thompson disclosing a safety razor with a guard holder for positioning a blade at a right angle to the razor; U.S. Pat. No. 1,639,441 to Spahr disclosing a safety razor with a universal hinge to pivot the blade; U.S. Pat. No. 1,507,737 to James disclosing a safety razor; U.S. Pat. No. 1,498,890 to Steedman disclosing a safety razor which may be positioned at a right angle to a handle portion or lengthwise of the handle.

While each of the above described shaving devices function adequately, they each possesses drawbacks. The major drawback is that the razor heads are not positionable in an infinite number of positions or rotatable in a full 360-degree range about the handle. The patents described above which disclose razors that are rotatable, do not have either a cylindrical knob for adjusting the angular position of the blade or a spring-mounted blade that permits the locking of the razor into a specified position. Moreover, the limited number of rotational positions does not eliminate the ergonomic problems associated with difficult to reach portions of the body.

Therefore, what is desirable is a shaving device with a spring-mounted razor blade being rotatable about an offset handle in an infinite number of positions and a full 360-degree range of motion, wherein the shaving device has a knob for full rotation and a switch for locking the razor at any specified angle, until such time as the user releases the switch.

SUMMARY OF THE INVENTION

It is therefore an object of the present invention to provide a shaving device for accurately and precisely cutting accessible as well as difficult to reach areas of the human body.

Additionally, it is a further object of the present invention to provide a razor head which is adjustably rotated in an infinite number of positions and a full 360-degree range of motion about the handle that alleviates the ergonomic difficulties associated with traditional shaving devices.

Furthermore, it is another object of the present invention to provide a spring-mounted blade attached to the razor head which may be positioned angularly relative to the razor head.

Moreover, it is a still further object of the present invention to provide a razor head and offset handle to accommodate a more comfortable grip for the user of the shaving device.

An even further object of the present invention is to provide a shaving device which is simple, practical, and comparatively inexpensive to manufacture, yet rugged and dependable in operation.

In accordance with the present invention, the detailed shaving device includes a spring-mounted, infinitely rotatable razor head with a full 360-degree range of motion attached to a handle with an angular offset for improved grip. The razor head includes a knob for adjusting the rotation of the blade and the knob has a switch that locks and releases the razor head from its angular position about the handle portion. Finally, the shaving device also includes a spring mechanism to ensure a safe and comfortable shave.

BRIEF DESCRIPTION OF THE DRAWINGS

The present invention will now be described in detail with reference to the attached drawings in which:

FIG. 4 is a depiction of multiple side views of one embodiment of the shaving devices according to the present invention.

FIG. 4*a* depicts the shaving device of the present invention in one locked position.

FIG. 4*b* depicts the shaving device of the present invention in the unlocked position.

FIG. 4*c* depicts the rotation method of shaving device in the unlocked position.

FIG. 4*d* depicts the shaving device in another possible locked position.

DETAILED DESCRIPTION OF THE INVENTION

Shaving devices to date have introduced improvements related to providing a better cut. Some shaving devices provide a double blade, a pivoting head, or a semi-rotating blade. None of the shaving devices, however, solve the ergonomic problems encountered with detailed cutting in difficult to reach areas of the body.

In the prior art, the positioning of the razor with respect to the handle makes the shaving devices inadequate for providing a good shave in difficult to reach areas. Often while using the shaving device, the razor together with the handle is directed toward a part of the surface being cut and the remainder of the surface is overlooked. Likewise, the central disposition of the razor with respect to the handle reduces a user's visibility to the areas surrounding the shaving device.

Therefore, the shaving device disclosed consists of a special design that facilitates detailed cutting, which is necessary in every shaving process. In the case of trimming and/or shaving a mustache, beard or side whiskers, precision shaving is very important and is facilitated with the disclosed device. The shaving device of the current invention comprises a spring-mounted, 360-degree rotatable razor blade head of reduced dimension to manipulate the act of shaving with maximum precision. The invention allows the user to direct the razor to the precise part of the face or other body surface being shaved while maintaining an ergonomically comfortable hand position.

In accordance with the goals of the present invention, the detailed shaving device is an infinitely positionable razor having a handle formed on an angular offset for improved manual grip and a razor blade mounted on the front of a blade cylinder head capable of rotating a full 360-degrees about its central axis. The turning mechanism is a knob connected to the razor blade in such a way as to transfer the angular rotation of the knob to the blade cylinder head and the razor blade. The locking means of the invention also allows the user to position the blade in an infinite number of positions about the 360-degree range of rotation. Finally, a spring connecting the handle portion to the blade cylinder head is provided for dampening the linear motion of the device during shaving.

Figure 1:
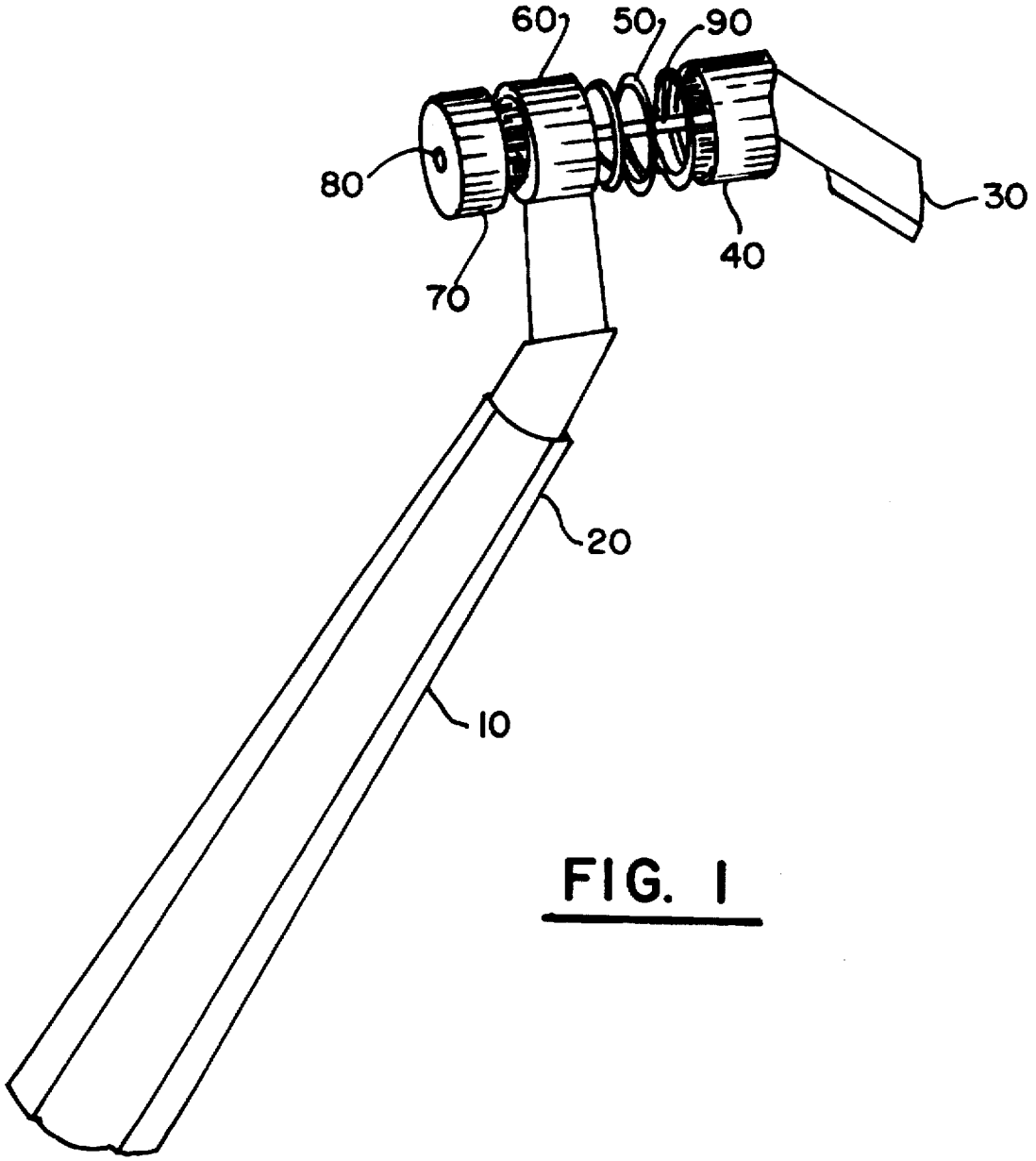
FIG. 1 is a side view of a shaving device with a handle, knob, spring, and adjustable razor head according to the present invention.
Figure 2:
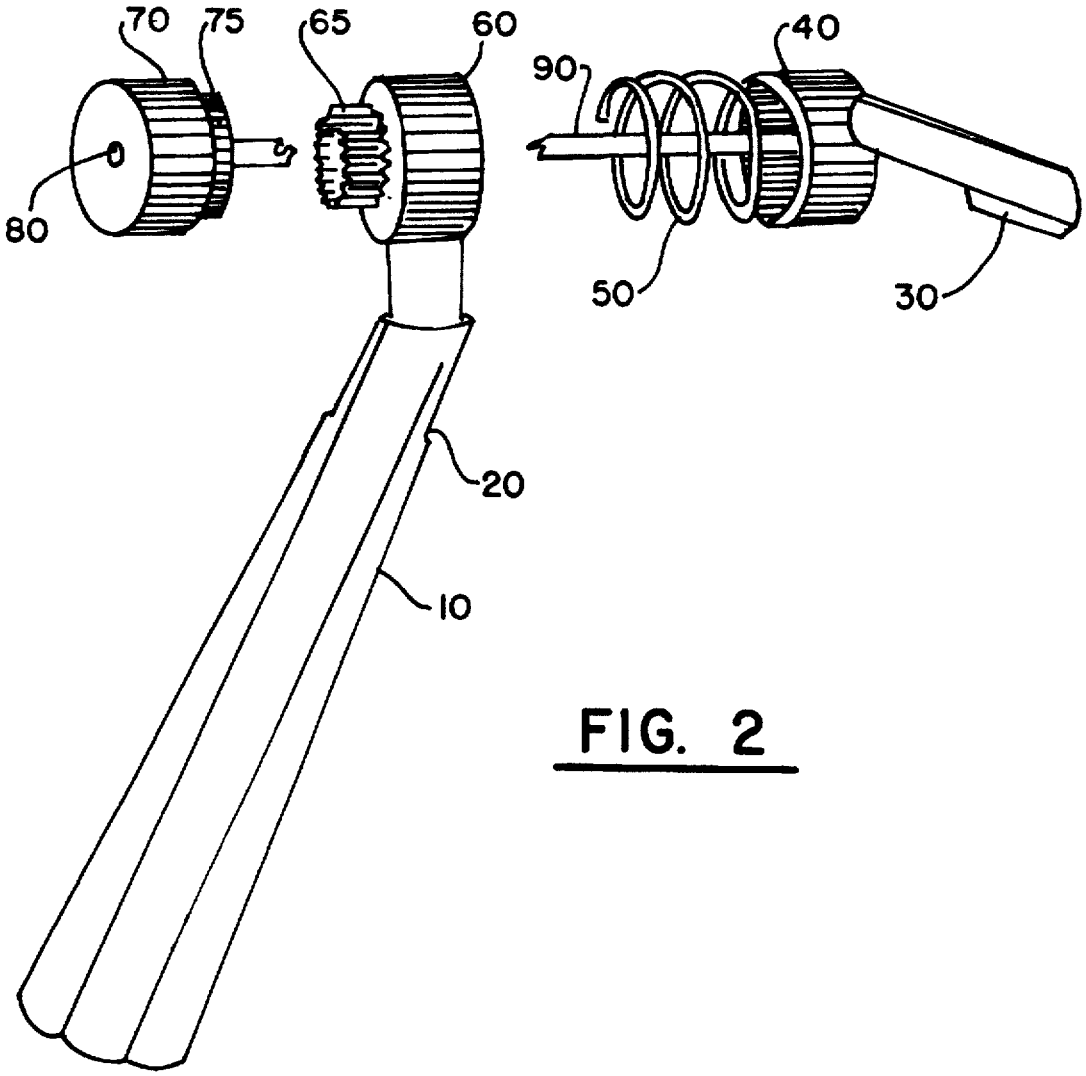
FIG. 2 is an exploded side view of a shaving device with a handle, knob, spring, and adjustable razor head according to the present invention.

FIG. 1 illustrates a novel detailed shaving device 10. The shaving implement includes a handle 20 offset at an angle for a more comfortable grip. The shaving device has a razor blade 30 attached to the front of the blade cylinder head 40 that is rotatable in a 360-degree range of motion. The back of the blade cylinder head 40 connects to one end of a spring 50 while the other end of the spring 50 connects to the front of the central cylinder head 60. The back of the central cylinder head 60 meshes with a knob 70 of generally cylindrical shape for rotating the blade cylinder head 40 using a turning gear 65 and a mating gear 75 (FIG. 2). The connecting rod 90 connects through the center of the blade cylinder head 40, the central cylinder head 60, and the knob 70. This connecting rod 90 allows the angular rotation of the knob to control the angular rotation of the blade cylinder head 40 and the razor blade 30. Furthermore, the back of the knob 70 includes a locking switch 80 which allows the user to lock and release any particular angular position of the rotating razor blade 30 by preventing the rotation of the turning gear 65 (FIG. 2). The connecting rod also allows the spring 50 to coil and uncoil along the central axis of the cylinder heads and dampen the movement of the razor blade 30 to ensure a smooth comfortable shave.

In one preferred embodiment, the razor blade 30 may be used in an angular position relative to the handle 20 whereby the overall length of the detailed shaving device 10 is at a maximum. See FIG. 4*a*. This angular position of the razor blade 30 relative to the handle 20 is the most effective means for providing an accurate shave and maximum reach for difficult to reach areas of the body.

FIG. 2 illustrates an exploded side view of a detailed shaving device that depicts the rotation mechanism of the preferred embodiment. The back end of the connecting rod 90 is connected to a turning gear 65. The turning gear 65 meshes with a mating gear 75 that is part of the internal front portion of the knob 70. This dual gear mechanism transfers any rotation of the knob 70 to the blade cylinder head 40 and the razor blade 30.

Figure 3:
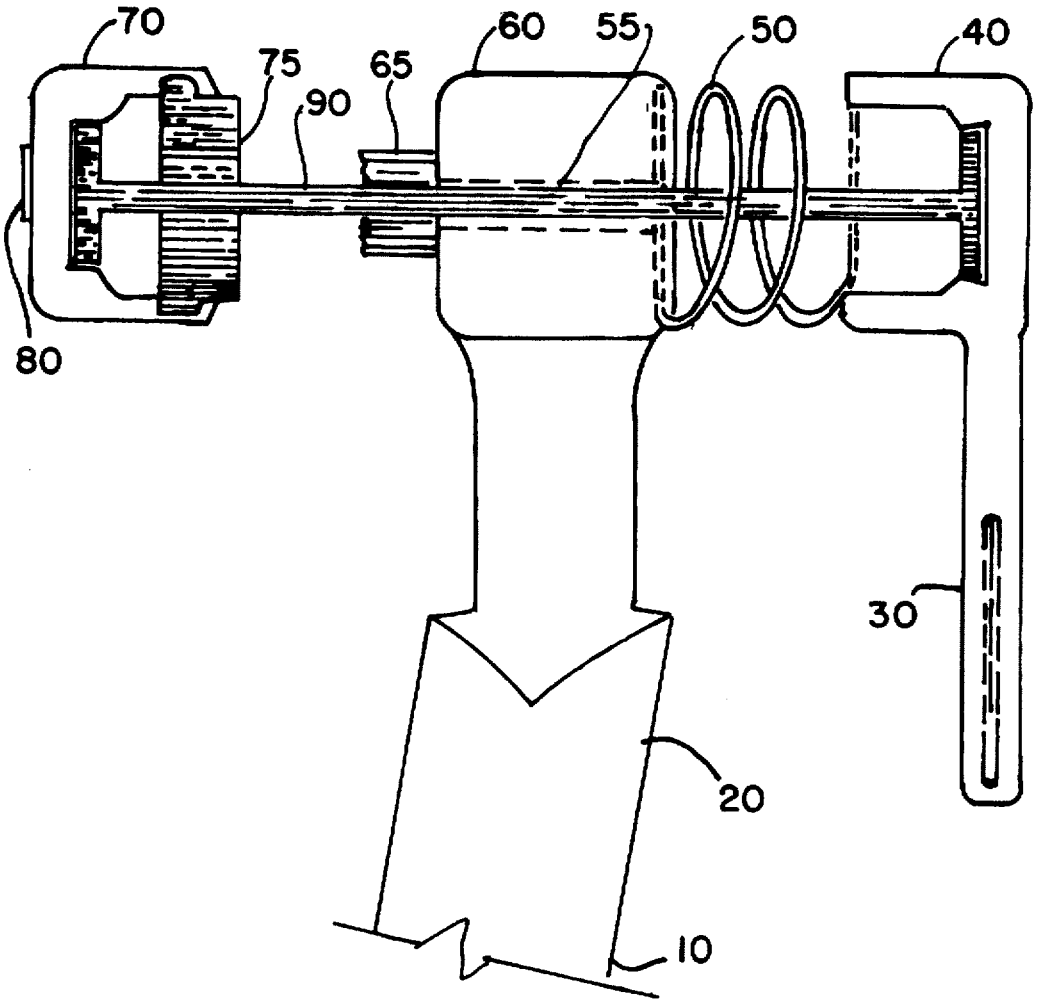
FIG. 3 is a sectional view of the shaving device head.

FIG. 3 illustrates an interior sectional view of the shaving device depicting the method of connecting the separate parts of the detailed shaving device 10. The razor blade 30 attaches to the front of the blade cylinder head 40 at a generally perpendicular angle to the central axis of the blade cylinder head 40. The blade cylinder head 40 is first connected to the connecting rod 90 along the central axis of the blade cylinder head 40. The blade cylinder head 40 then connects with one end of a spring 50 through an orifice or other similar connection means. The other end of the spring 50 attaches into an orifice or other similar connection means in the front of the central cylinder head 60. The central cylinder head 60 contains a central orifice 55 that houses the connecting rod 90. This central cylinder head also attaches to the handle 20. The back of the central cylinder head 60 connects to the turning gear 65 that is fixed to the connecting rod 90. This turning gear 65 meshes with the mating gear 75 that is attached to the knob 70. The combination of the connecting rod 90, blade cylinder head 40, turning gear 65, mating gear 75, and knob 70 allows the angular rotation of the knob to control the angular rotation of the blade cylinder head 40 and the razor blade 30. Furthermore, the back of the knob 70 includes a locking switch 80 which allows the user to lock and release any particular angular position of the rotating razor blade 30 by preventing the rotation of the turning gear 65. The connecting rod is also attached to the blade cylinder head 40 to allow the spring 50 to coil and uncoil along the central axis of the cylinder heads and dampen the movement of the razor blade 30 to ensure a smooth comfortable shave.

FIG. 4 illustrates another preferred embodiment of the detailed shaving device 10. In this preferred embodiment, the detailed shaving device uses a fixed locking gear 66 and a knob mating gear 76 to adjust the angular position of the rotating razor blade 30. Rather than employing a locking switch to prevent rotation of the razor blade 30 and blade cylinder head 40, the preferred embodiment of FIG. 4 allows the knob 70 to act as both the rotating mechanism and the locking mechanism.

FIG. 4*a* depicts the detailed device 10 in one possible locked position. FIG. 4*b* shows the detailed shaving device 10 in the unlocked position. FIG. 4*c* portrays the rotation method of the detailed shaving device 10 in the unlocked position. FIG. 4*d* renders the detailed shaving device 10 in another possible locked position.

In this preferred embodiment, the detailed shaving device 10 still allows the user to shave in difficult to reach areas and permits a full 360-degree range of rotation. The number of potential locked positions along the 360-degree range, however, is finite and dependent upon the number of gear teeth in the locking mechanism.

This preferred embodiment includes a handle 20 for a shaver's grasp and razor blade 30 mounted on the front side of a blade cylinder head 40 capable of rotating a full 360-degrees about the central axis. A central cylinder head 60 is attached to the handle 20. The central cylinder head 60 has a central orifice allowing the connecting rod 90 to rotate freely about the central axis of the cylinder head 40.

The turning and locking mechanism is first made up of a generally hollow knob 70 where the hollow portion of the knob contains a knob mating gear 76 for helping to adjust the locked position of the blade cylinder head. Another part of the locking mechanism is a fixed locking gear 66 that mates with the knob mating gear 76 to prevent the blade cylinder head 40 from rotating. The fixed locking gear 66 is bound to the back of the central cylinder head 60 and the knob mating gear 76 connects with the fixed locking gear 66 to lock the angular position of the blade cylinder head 40 in several indexed positions. The indexed positions are determined by the number of gear teeth of the fixed locking gear 66 and the knob mating gear 76. The final part of the locking mechanism is a spring 50 attached to the back of the blade cylinder head 40 and the front of the central cylinder head 60 that serves to lock and release the blade cylinder head 40 by allowing the fixed locking gear 66 and knob mating gear 76 to mate and unmate. Finally, a connecting rod 90 attaches the knob 70 to the blade cylinder head 40 and maintains a fixed distance between the knob 70 and the blade cylinder head 40.

Figure 5:
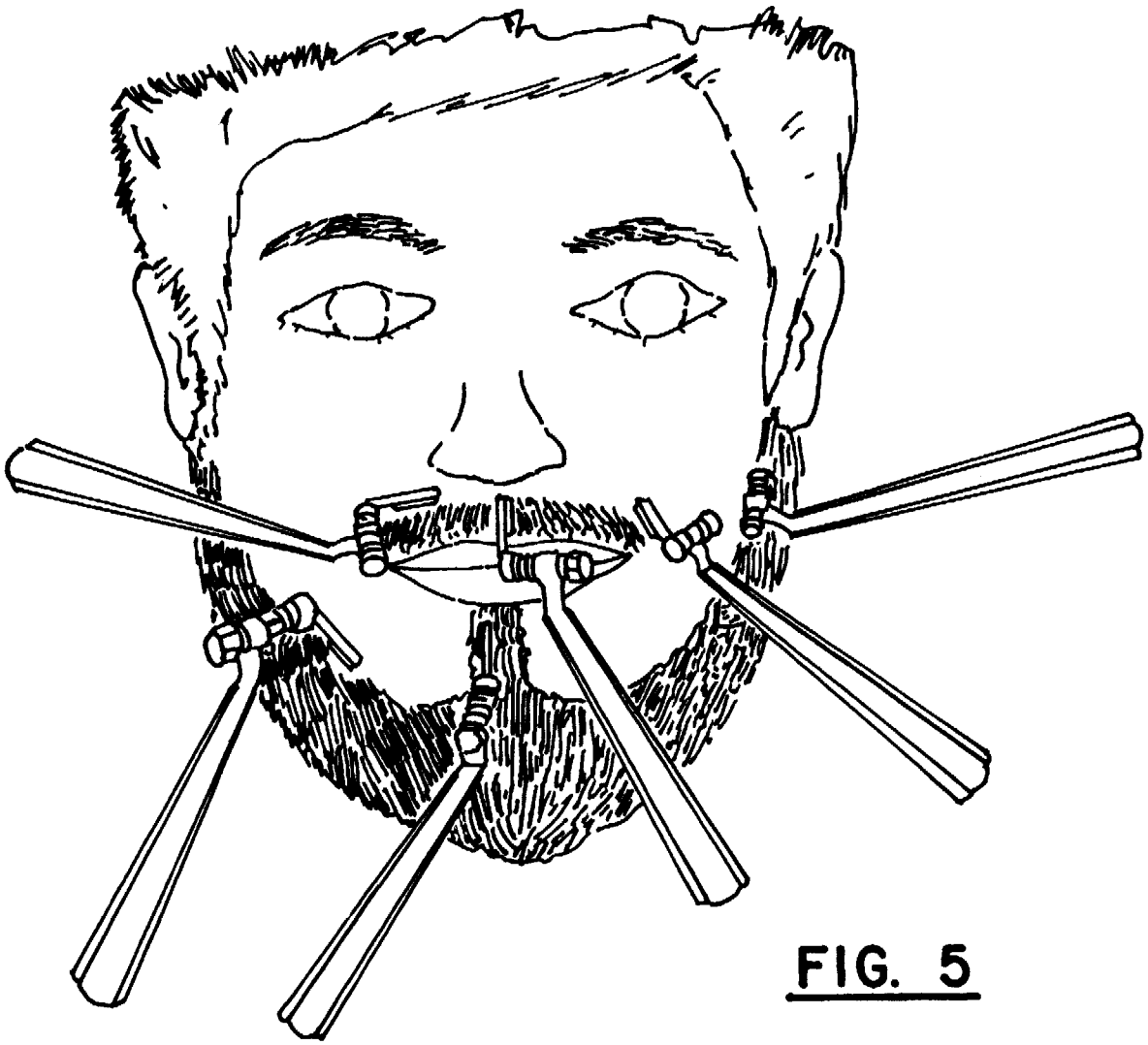
FIG. 5 is a front view of the shaving device along different areas of the human face according to the present invention.

FIG. 5 illustrates the use of the detailed shaving device of the present invention along several different areas and positions of the human face.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A shaving device for shaving in difficult to reach areas comprising:

a handle for a shaver's grasp;

a blade cylinder head capable of rotating a full 360-degrees about its central axis;

a razor blade mounted on the front side of said blade cylinder head;

a generally hollow knob containing a hollow portion, wherein the hollow portion contains a knob mating gear for adjusting the locked position of the blade cylinder head;

a connecting rod attaching said knob to said blade cylinder head, whereby said connecting rod maintains a fixed distance between said knob and said blade cylinder head;

a central cylinder head attached to said handle, said central cylinder head having a central orifice allowing said connecting rod to rotate freely about the central axis of said central cylinder head;

a fixed locking gear attached to the back of said central cylinder head, whereby said knob mating gear connects with said locking gear to lock the angular position of said blade cylinder head in several indexed positions, whereby the indexed positions are determined by the number of gears of said locking gear and said mating gear.

a spring attached to the back of said blade cylinder head and the front of said central cylinder head for locking and releasing said blade cylinder head.

2. A shaving device with a positionable razor comprising:

a handle formed with an angular offset for improved manual grip;

a blade cylinder head having a central axis, wherein the blade cylinder head is capable of rotating a full 360-degrees about the blade cylinder head central axis, a razor blade mounted on the front side of said blade cylinder head;

a central cylinder head attached to said handle, said central cylinder head having a central cylinder head central axis and a central orifice;

a spring attached to the back of said blade cylinder head and the front of said central cylinder head, said spring dampening the linear motion of said blade cylinder head along its central axis;

a knob connected to the back of said central cylinder head for rotating said blade cylinder head;

a locking means for holding said blade cylinder head in a variety of positions along the 360-degree range of rotation relative to the central axis of said blade cylinder head; and a connecting means freely rotatable in said central orifice for transferring the angular rotation of said knob to the angular rotation of said blade cylinder head and said razor blade.

3. The shaving device of claim 1, further comprising a turning gear connected to said central cylinder head and wherein said locking means further comprises a switch on the back side of said knob for locking said razor in a variety of positions along the 360-degree range of rotation relative to the central axis of said blade cylinder head by preventing the rotation of said turning gear.

4. The shaving device of claim 1, wherein said razor blade further comprises a razor blade of reduced dimension.

5. The shaving device of claim 1, further comprising a turning gear connected to said central cylinder head and a mating gear connected to said knob, wherein said connecting means further comprises a connecting rod connecting said knob and said blade cylinder head with said turning gear and said mating gear for transferring the angular rotation of said knob to the angular rotation of said blade cylinder head and said razor blade.

6. The shaving device of claim 1, wherein one end of said spring is attached to an orifice in the back of said blade cylinder head and the other end of said spring is attached to an orifice in the front of said central cylinder head, said spring dampening the linear motion of said blade cylinder head along its central axis.

7. The shaving device of claim 1, wherein said blade is locked in an angular position whereby the overall length of said shaving device is at a maximum.

* * * * *